United States Patent [19]

Peterson

[11] 3,977,721

[45] Aug. 31, 1976

[54] REPLACEABLE FLEXIBLE BACK PANEL FOR FOLDING CHAIRS

[75] Inventor: Walter F. Peterson, Racine, Wis.

[73] Assignee: Gold Medal, Inc., Racine, Wis.

[22] Filed: June 26, 1975

[21] Appl. No.: 590,451

[52] U.S. Cl. ..... 297/45; 297/226; 297/441

[51] Int. Cl.[2] ..... A47C 4/28

[58] Field of Search ..... 297/45, 36, 226, 441; 5/98 R, 99 A, 114, 122

[56] References Cited

UNITED STATES PATENTS

| | | | |
|---|---|---|---|
| 1,977,766 | 10/1934 | Kivler | 297/45 |
| 2,172,890 | 9/1939 | Phillips | 297/226 |
| 2,657,737 | 11/1953 | Kanaval | 297/45 X |
| 2,699,816 | 1/1955 | Gittings | 297/45 X |
| 3,136,272 | 6/1964 | Sprigman | 297/45 X |

FOREIGN PATENTS OR APPLICATIONS

| | | | |
|---|---|---|---|
| 155,705 | 11/1904 | Germany | 297/441 |
| 765,094 | 1/1957 | United Kingdom | 297/441 |

*Primary Examiner*—Roy D. Frazier
*Assistant Examiner*—William E. Lyddane
*Attorney, Agent, or Firm*—James E. Nilles

[57] ABSTRACT

A flexible back panel for collapsible or folding chairs, the flexible back panel having fastening means so it can be utilized with two different types of folding chairs.

5 Claims, 12 Drawing Figures

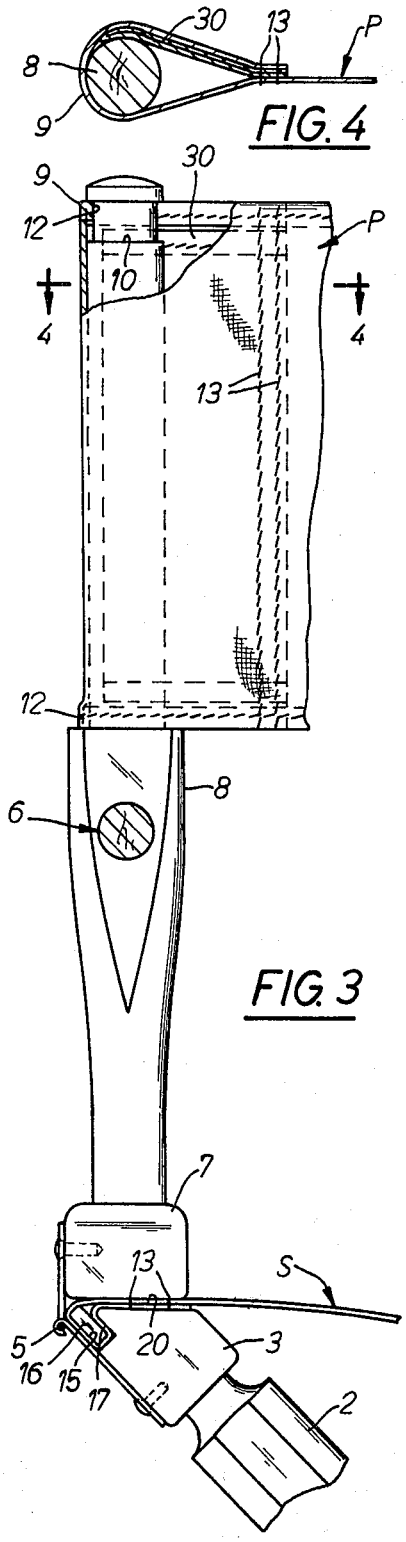
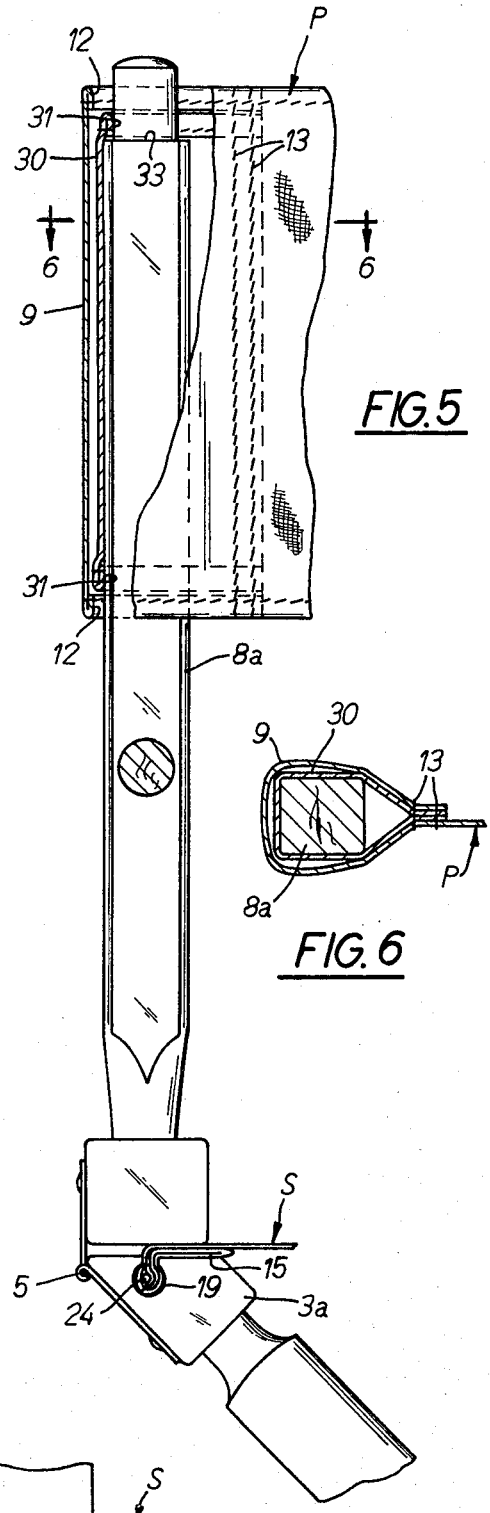
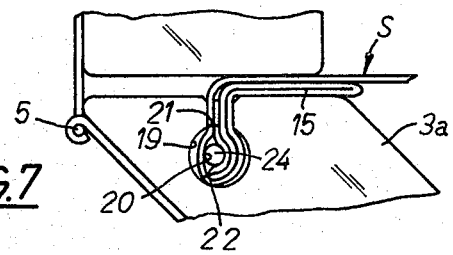
FIG. 7

REPLACEABLE FLEXIBLE BACK PANEL FOR FOLDING CHAIRS

BACKGROUND OF THE INVENTION

The invention pertains generally to folding chairs, commonly referred to as directors chairs, of the type having a flexible canvas fabric or other material from which the replacable seats and back panels are made. These seats and back panels can be detachably removed from the folding side members of the chair so that the chair can be easily folded from a stored to an operative position. The seat and panel members are replacable for washing, repair, or replacement.

These various prior art chairs have different dimensions and locations for securing the flexible seat member to the side assemblies of the chairs, thus requiring special sized seats for different types of chairs. One such chair is shown in the U.S. Pat. No. 2,699,816 issued Jan. 18, 1955. Generally speaking these seats have loops formed along each of their sides for the reception of cores, which are then inserted in grooves that are located in different positions on the chair side assemblies, thereby requiring seats of different widths in order to accommodate the different makes of chairs.

Similarly, the back panels of these chairs generally have loops along each of their vertical edges which are slipped over the spaced apart back posts of the chairs, the spacing between the back posts of various makes of chairs differs thereby requiring separate panels for each type of chair. In some of these chairs, the back panel is prevented from sagging on the post by means of a welt on the back panel which fits a notched groove in the posts. An example of such a chair is shown in the U.S. Pat. No. 2,582,864 issued Jan. 15, 1952.

Both of the above patents have been assigned to an assignee common with the present invention.

Because of different types or makes of folding chairs, it has been a problem for the manufacturers and sales outlets to manufacture and stock the various sizes and types of seats and panels for this type of chair.

SUMMARY OF THE INVENTION

The present invention provides a flexible back panel for folding chairs, which panel has means for use with a plurality of different makes or types of folding chairs.

More specifically, the present invention provides flexible, replacable back panels for the chair back posts which are spaced apart at different distances.

The back panels provided by the present invention can easily accommodate different types of makes of folding chairs and can be produced economically and permit a considerable reduction in the number of such replacable parts that it is necessary for the manufacturer to produce or a dealer to stock.

These and other objects and advantages of the present invention will appear hereinafter as this disclosure progresses, reference being had to the accompanying drawings.

THE DRAWINGS

FIG. 3 is a front elevational view of a portion of the chair shown in FIG. 2, but on a slightly enlarged scale, certain parts being shown as broken away or in section for clarity;

FIG. 4 is a sectional view taken along line 4—4 in FIG. 3;

FIG. 5 is a view similar to FIG. 3, but showing a chair of a different size and having a different type of seat fastening means;

FIG. 6 is a sectional view taken along line 6—6 in FIG. 5;

FIG. 7 is a fragmentary view of a portion of the seat attaching means shown in FIG. 5, but on a slightly enlarged scale;

DESCRIPTION OF THE INVENTION

The present invention is used with a chair of the folding type, commonly referred to as a director's chair and which utilizes a flexible seat and a flexible back panel both of which can be removed for repair, replacement, or cleaning. Generally, these chairs consist of a base 1 including front and rear sets of pivotally connected cross legs 2 doweled or otherwise secured at their upper ends to the bottom faces of a pair of side rails 3. Conventional jointed brackets 4 connected to the front set of cross legs and/or rear set of cross legs serve to latch the legs in expanded operative position.

Figure 1:
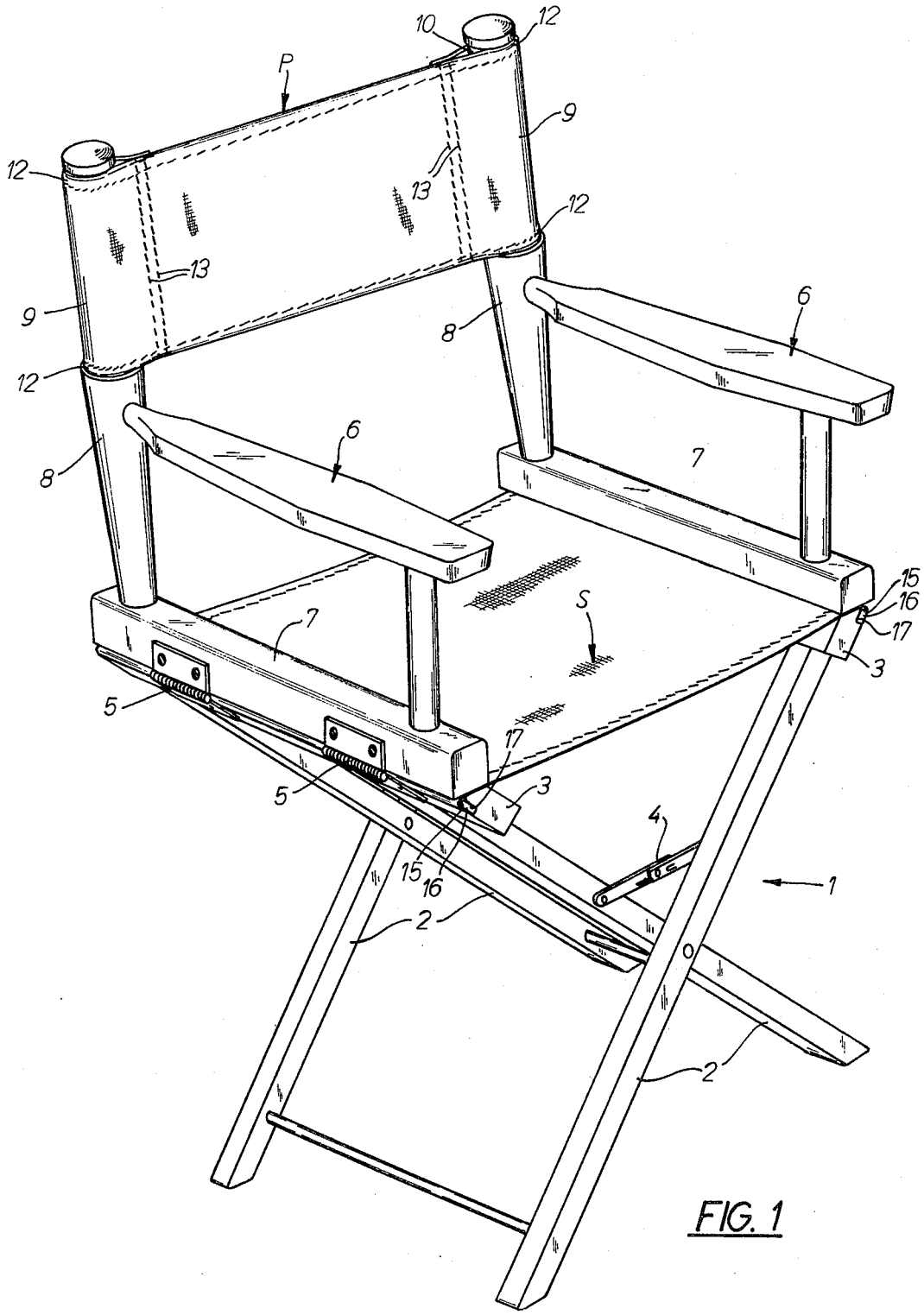
FIG. 1 is a perspective view of a folding chair embodying the present invention.
Figure 2:
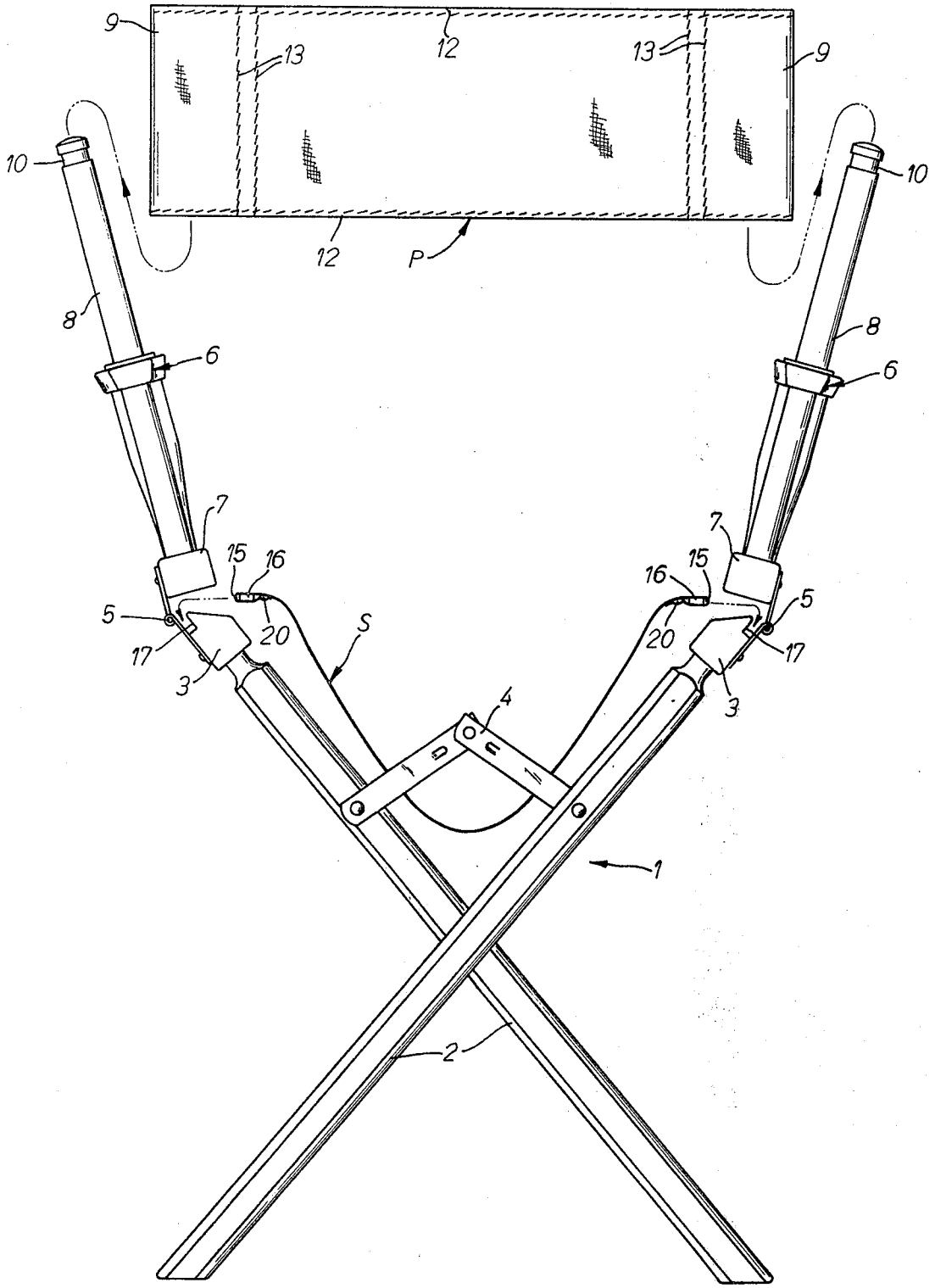
FIG. 2 is a front elevational view of the chair shown in FIG. 1, but showing the legs when slightly collapsed, the back panels removed from the back posts and the arm side rail assemblies swung to a partially closed position.

Pivotally connected to the side rails 3 by means of hinges 5 is a pair of arm rest assemblies 6, these assemblies include runners 7 supported on the side rails in operative position and which are connected to the upper portion of the hinges 5. The assemblies also include a pair of back posts 8 that receive the end loops 9 of the fabric, flexible back panel P. The panel P is formed from a piece of generally rectangular fabric or other flexible material, having a welt 12 along its upper and lower edges. The panel also has opposite vertical edges with a portion of the material folded over itself along its side edges and stitches as at 13 to form the loop 9. The upper ends of the posts 8 of the chair shown in FIG. 2 have a groove 10 formed around the periphery for the reception of the welt 12 whereby the welt 12 fits snugly in the groove 10 of the back post to prevent sagging of the panel downwardly of the posts.

Figure 9:
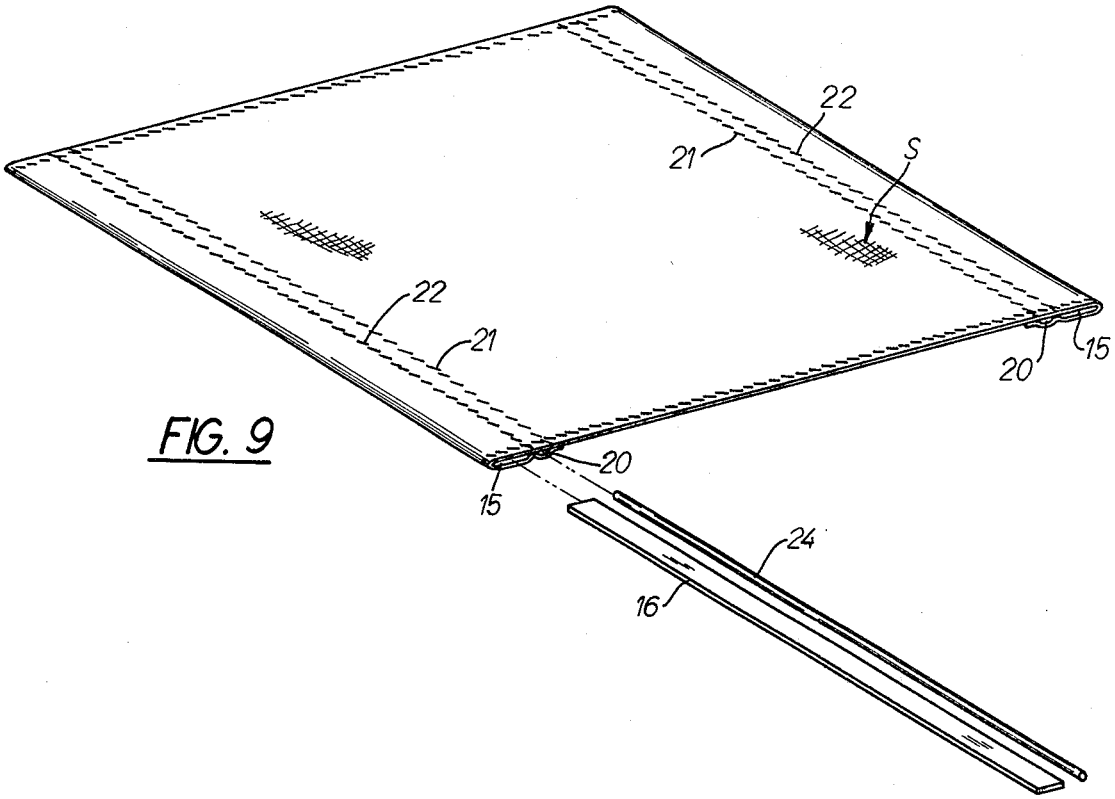
FIG. 9 is a perspective view of the flexible seat shown in FIG. 8 and also showing the cores in an exploded position.
Figure 8:
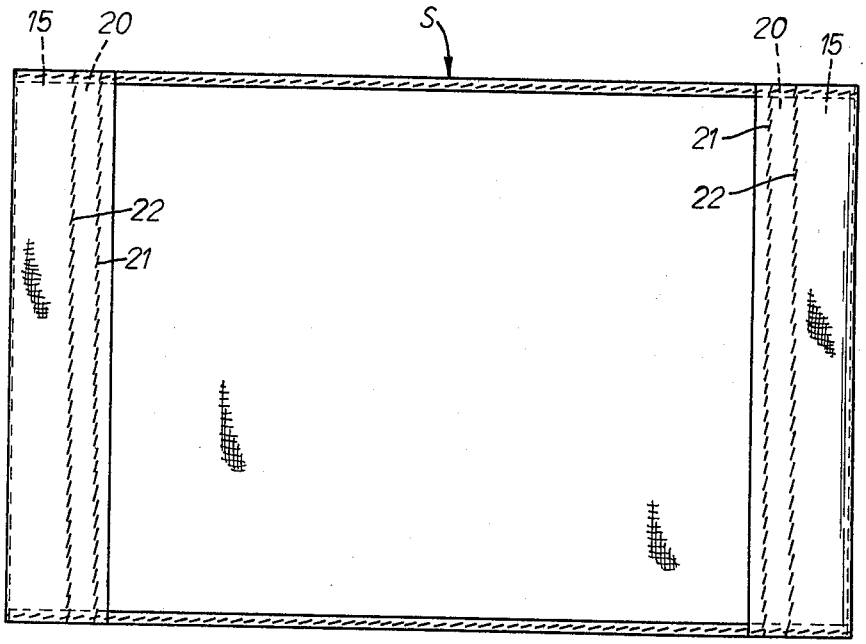
FIG. 8 is a bottom view of the flexible seat used with the chairs shown in FIGS. 3 and 5.

The seat S shown in FIGS. 3, 8 and 9 have a portion along each of their edges doubled over and sewn to the main seat portion so as to form a loop 15 along each edge of the seat panel. A core 16 such as a wooden strip is insertable in the loops 15 and the core and its loop can then be inserted in the groove 17 formed along the outer edge of the rail 3. Thus, when the side arm assemblies are folded upwardly to the position shown in FIG. 3, the seat S is held captive in the groove 17. The above means of securing the seat S is shown and described in the U.S. Pat. No. 2,582,864 issued Jan. 15, 1952 and which has been assigned to an assignee common with the present invention. Furthermore, the above described means for removably placing the back panel on the back posts is shown and described in the U.S. Pat. No. 2,699,816 issued Jan. 18, 1955, which patent has also been assigned to an assignee common with the present application.

There are chairs having slightly different dimensions than the above described chair and furthermore, these other chairs have slightly different means for securing the seat to the side runners of the base part of the chair. An example of other types of chairs are shown in FIGS. 5, 6 and 7 wherein the space between the back posts 8a may be slightly less than the chair of FIG. 3 and furthermore where the seat S is secured in a groove 19 that is located on top of side rail 3a rather than on the outer edge of the side rail 3 as in FIG. 3.

As a result, when a customer desired to obtain replacement back panels for these chairs, he is often at a loss to ascertain when he enters the retail store just which make panel he should purchase for his particular chair. Similarly, the retail operator has been heretofore required to stock excessive numbers and types of back panels.

According to the present invention, an improved back panel has been provided and which can be used with either of the types of chairs shown in FIGS. 3 and 5.

The improved seat S is shown clearly in FIGS. 8 and 9 and includes a second loop 20 formed generally along each of the side edges of the panel. More specifically, the second loop 20 is formed inwardly of and adjacent to the loop 15. This loop is formed by the inner row of stitching 21 and by the outer row of stitching 22 which forms a portion of the loop 20. A second dowel or core 24 is provided for this second loop 20. Thus, for a chair of the type shown in FIG. 5 where the groove 19 in the side rails are located closer to one another than those shown in FIG. 3, the seat panel is effectively made shorter between its side edges by means of utilizing the loops 20, rather than the loops 15. When they are thus used, the looped portion 15 as shown in FIG. 5 is folded under the main portion of the seat.

Figure 10:
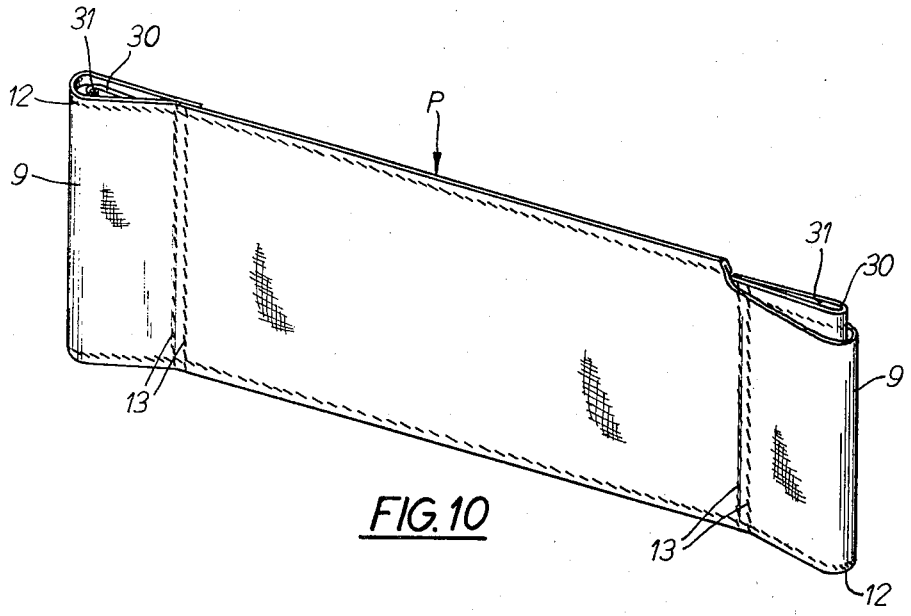
FIG. 10 is a perspective view of a flexible back panel used with the chairs shown in the other views, certain portions being shown as broken away for the sake of clarity.
Figure 11:
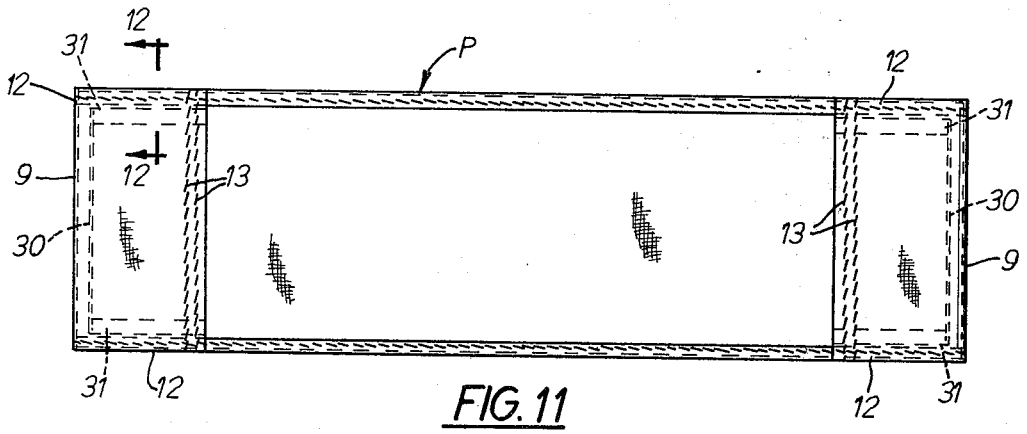
FIG. 11 is a rear view of the flexible panel shown in FIG. 10.
Figure 12:
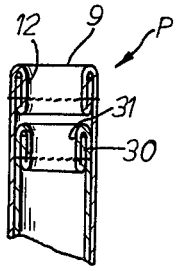
FIG. 12 is a sectional view taken along line 12—12 of FIG. 11 but on an enlarged scale.

In connection with the back panel shown in FIGS. 10, 11 and 12 and made in accordance with the present invention, it will be noted that a second loop 30 is formed within the conventional or first outer loop 9 and is shorter in height (as shown in FIGS. 11 and 12) than the outer loop. Thus the welts 12 and 31 along the upper and lower edges of the panels nest together smoothly without bulkiness or overlap, and the inner loop is hidden. The rows of stitching 13 secures loop 30 within loop 9. Thus, the effective length of the back panel is decreased to accommodate the chair of FIG. 5 by means of using the inner loop 30 as shown in FIGS. 5 and 6. The welt 31 formed in the loop 30 is then used to rest on the shoulder 33 of the back post to prevent sag of the back panel.

Thus by means of the present invention, an improved, flexible back panel is provided and which can be used with different styles of chairs.

I claim:

1. A flexible back panel for a folding chair and comprising, a generally rectangular piece of flexible material having a welt defining an upper and lower side of said panel, said panel having opposite, vertical edges, and a first loop and a second loop having open upper ends and forming a pair of loops along each of said opposite edges for the selective reception of a folding chair back post therein, said second loops being located generally concentrically within their respective first loops, said first loops of said pairs of loops being spaced farther apart from one another than the second loops of said pairs of loops, whereby the effective length between the first loops is greater than the length between the second loops.

2. The panel set forth in claim 1 further characterized in that said loops each have welts along their upper and lower sides, and said inner loops are of shorter height than the outer loops whereby the welts nest smoothly therein.

3. A flexible back panel for a folding chair of the type having two spaced apart, upwardly extending back posts, said panel comprising, a generally rectangular piece of flexible material having a welt defining an upper and lower side of said panel, said panel having opposite, vertical edges, and a first loop and a second loop within said first loop and generally concentric therewith and forming a pair of concentric loops along each of said opposite edges for the selective reception of said back posts therein, said first loops of said pairs of loops being spaced farther apart from one another than the second loops of said pairs of loops, said loops having open upper ends for the passage of said posts therethrough to permit the top of said posts to extend upwardly through said loops.

4. The panel set forth in claim 3 further characterized in that said inner loops are of shorter height than the outer loops whereby the welts nest smoothly therein.

5. The panel set forth in claim 3 further characterized in that said posts have an annular notch around their upper end and said welts are adapted to be received in said notches.

* * * * *